US006813854B2

(12) United States Patent
Popikow

(10) Patent No.: US 6,813,854 B2
(45) Date of Patent: Nov. 9, 2004

(54) BOLT SYSTEM FOR MULTIBARREL RIFLES

(75) Inventor: Sergej Popikow, Weitnau (DE)

(73) Assignee: S.A.T., Neuhausen (CH)

( * ) Notice: Subject to any disclaimer, the term of this patent is extended or adjusted under 35 U.S.C. 154(b) by 0 days.

(21) Appl. No.: 10/631,325

(22) Filed: Aug. 1, 2003

(65) Prior Publication Data

US 2004/0093782 A1 May 20, 2004

(30) Foreign Application Priority Data

Aug. 2, 2002 (DE) ..... 102 35 282

(51) Int. Cl.[7] ..... F41A 3/00
(52) U.S. Cl. ..... 42/41; 42/42.02; 89/126
(58) Field of Search ..... 42/41, 42.01, 42.02, 42/69.01; 89/126, 127, 1.41

(56) References Cited

U.S. PATENT DOCUMENTS 3,392,470 A * 7/1968 Kavanagh ..... 42/10
3,800,455 A * 4/1974 Drevet ..... 42/42.01
5,465,518 A * 11/1995 Blaser ..... 42/70.08

FOREIGN PATENT DOCUMENTS

DE 3640606 C1 * 4/1988 ..... F41C/11/10
DE 4244168 C1 * 11/1993 ..... F41A/17/00

* cited by examiner

*Primary Examiner*—Jack Keith
*Assistant Examiner*—Gabriel S. Sukman
(74) *Attorney, Agent, or Firm*—Martin Fleit; Paul D. Bianco; Fleit Kain Gibbons Gutman Bongini & Bianco P.L.

(57) ABSTRACT

A bolt system for multi-barrel rifles with at least two firing pin pieces. Trigger levers are associated with the firing pin pieces. At least one trigger can rotate about a trigger axis. At least one pivotable pendulum weight is provided for avoiding an unintended firing of a shot. The pendulum weight is arranged on the trigger in such a manner that it can pivot about a pivot axis that is located, viewed in the direction of firing, in front of the trigger axis, and the center of gravity of the pendulum weight is located above the trigger axis.

9 Claims, 5 Drawing Sheets

BOLT SYSTEM FOR MULTIBARREL RIFLES

BACKGROUND OF THE INVENTION

1. Field of the Invention

The invention relates to a bolt system for a multibarrel rifle.

2. Prior Art

A bolt system for a multibarrel rifle is known from DE 42 44 168 C1. In it a pendulum weight cooperating with a bolt rod is articulated to the lock plate in such a manner that it can pivot about an axis parallel to the rod axis for protection against doubling or the unintended release of a shot upon jolts and agitations. The pendulum weight comprises a specially formed recess into which a pin projecting laterally from the bolt rod engages. The recess of the pendulum weight is designed in such a manner that the bolt rod can freely move to release a shot only in a non-pivoted middle position of the pendulum weight. In this middle position the pendulum weight is held by two return springs arranged on its bottom. If, on the other hand, the pendulum weight is pivoted to the front or to the rear, e.g., upon a recoil or a rebound of the rifle from the shoulder of the marksman, due to its inertia, the pin of the bolt rod engages into a front or rear lateral notch of the recess on the pendulum weight in such a manner that the bolt rod is blocked. In this position no shot can then be fired. The pendulum weight is not pivoted back into its middle position, in which the bolt rod can freely move to release the firing pin pieces, under the force of the two springs until the bolt system subsequently comes to rest. This achieves a double rod safety in order to avoid an undesired release of a second shot when the first shot is being fired. A disadvantage of this system is that upon a functional disturbance, caused, e.g., by corrosion, of the return springs or if they break, no return of the pendulum weight into the middle position takes place and thus the blocking of the bolt rod is retained. In the case of such a safety the cooperating parts must also be extremely precisely manufactured and exactly coordinated with each other in order to assure the operation, which requires a considerable expense for manufacture and assembly. In addition, such a safety must be carefully maintained since even rather small particles of dust or dirt can adversely affect its operation.

SUMMARY OF THE INVENTION

The invention has the problem of creating a bolt system of the initially cited type that makes possible an insensitive and reliable safety against doubling and the unintended firing of a shot upon jolts, agitations or the like.

This problem is solved by a bolt system with the features of Claim 1. Advantageous embodiments and purposeful further developments of the invention are indicated in the dependent claims.

The bolt system in accordance with the invention is distinguished in that a pivotable pendulum weight is articulated in such a manner to the trigger that its pivot axis is located, viewed in the firing direction, in front of the trigger axis and its center of gravity above the trigger axis. As a result, during a retrograde movement caused, e.g., by a recoil as well as by a forward movement caused by a rebound of the rifle from the shoulder of the marksman, a moment acting in the same direction is produced on the trigger that increases the force required for actuating the trigger, that is, the trigger resistance is increased. The greater the recoil or the rebound and therewith the acceleration of the pendulum weight, the greater this moment is. This achieves a dynamic and calibration-neutral safety adapted to the effects of jolts without blockage of the triggers or of other parts. The stronger the jolt effects in the longitudinal direction of the rifle, the more the trigger resistance is raised in order to prevent an unintended release of a shot. The safety system is comparatively insensitive and would even retain its mode of operation if the spring provided between the trigger and the pendulum weight breaks.

It is advantageous in a bolt system with a front and a back trigger if a pivotable pendulum weight is arranged on each of the triggers. The shape of the pendulum weights can be adapted in such a manner that they fit into the space available inside a bolt case.

BRIEF DESCRIPTION OF THE DRAWINGS

Further features and advantages of the invention result from the following description of a preferred exemplary embodiment with reference made to the drawings.

DETAILED DESCRIPTION OF PREFERRED EMBODIMENTS

Figure 1:
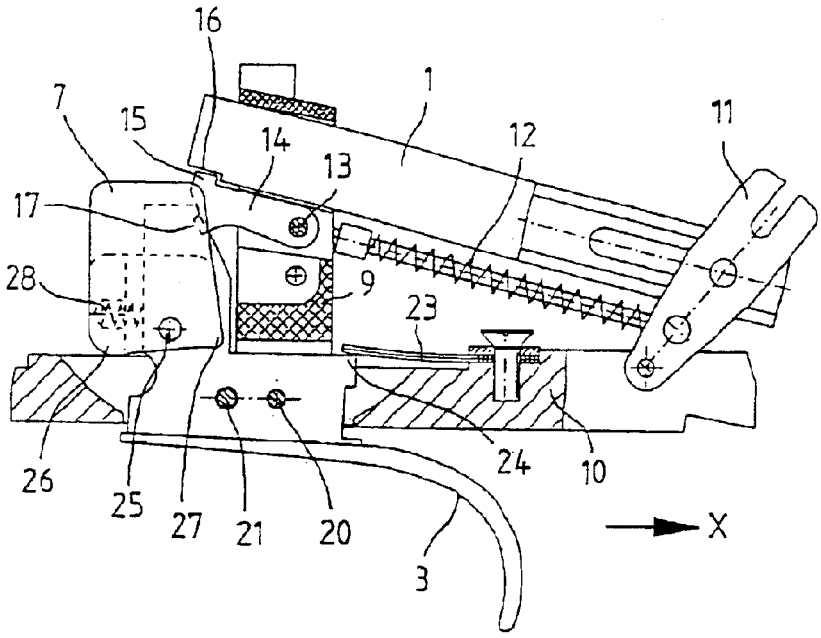
FIG. 1 shows a lateral view of a rifle bolt in the cocked position with a pendulum weight pivoted to the front.
Figure 9:
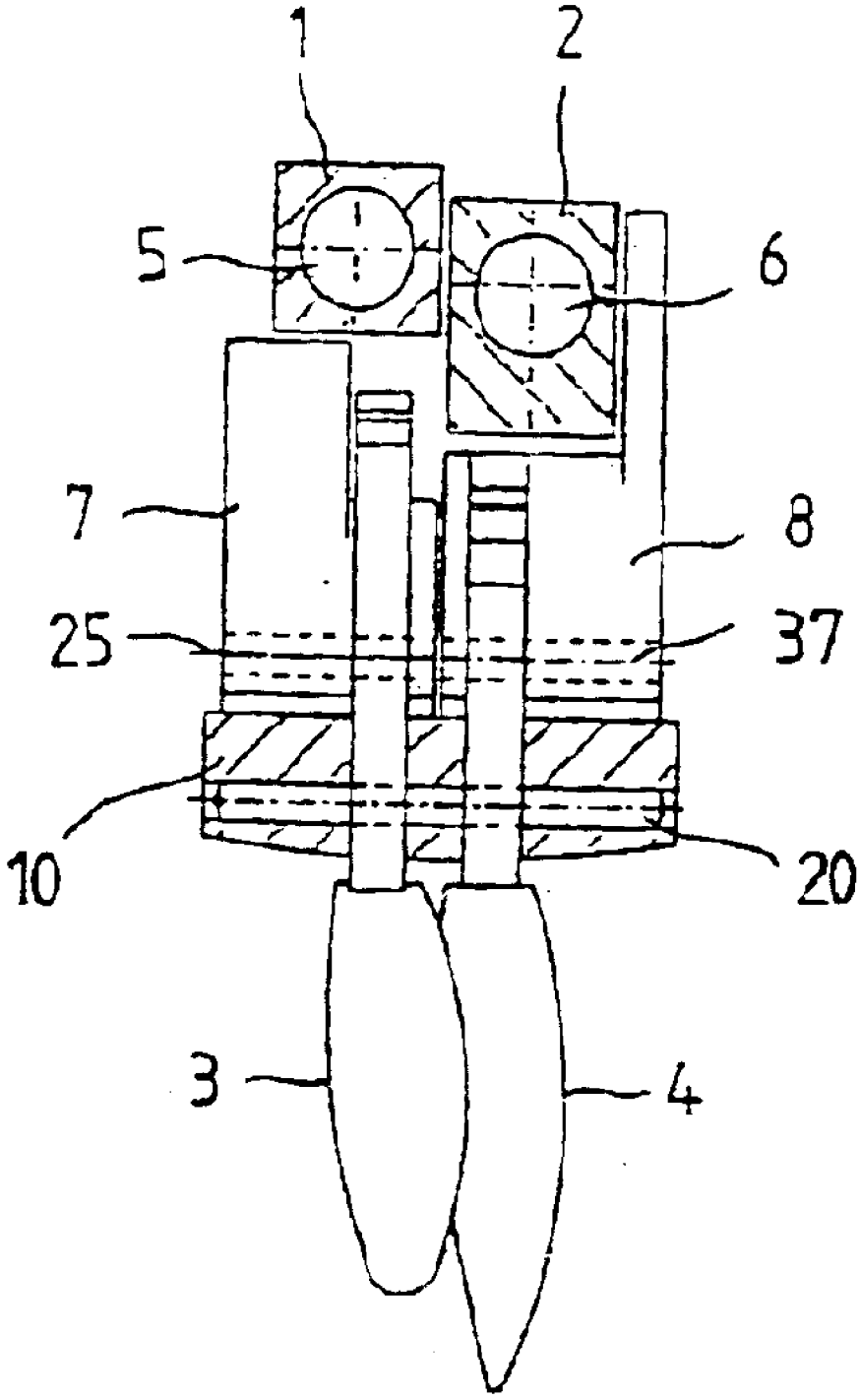
FIG. 9 shows a sectional view of a bolt system.

The side view of FIG. 1 shows (viewed in the direction of firing) the left bolt of a bolt system shown in section in FIG. 9 for multibarrel rifles. As is apparent from FIG. 9, the bolt system comprises two adjacent bolts, each with a firing pin piece 1, 2 that can be released by rear and by front triggers 3, 4 in order to fire a shot. The two firing pin pieces 1, 2 each have a bore 5, 6 in which a striker spring (not shown) for pre-tensioning the two firing pin pieces 1, 2 is housed. A pendulum weight 7, 8 explained in detail in the following is pivotably arranged in each of the two triggers 3, 4.

As is apparent from FIG. 1, firing pin piece 1 is movably guided in its longitudinal direction in guide part 9 arranged on lock plate 10. In addition, tensioning lever 11 is articulated on lock plate 10 by means of which lever the striker spring arranged in firing pin piece 1 can be tensioned by a tensioning slider (not shown). Return spring 12 is clamped between guide part 9 and tensioning lever 11. Trigger lever 14, which can pivot about pin 13, is articulated to guide part 9 by means of which trigger lever the firing pin piece 1 is held in its withdrawn position under tension. Trigger lever 14 has upper notch nose 15 that engages with corresponding recess 16 of firing pin piece 1 in the upper blocking position of trigger lever 14. Trigger lever 14 also has a lower notch nose 17 that engages into recess 18, shown in FIG. 2, on trigger leaf 19 of trigger 3. Trigger 3 is arranged so that it can rotate on lock plate 10 about trigger axis 20. The pivot movement of trigger 3 is limited by cross pin 21 and cross bore 22, which is greater in diameter, in trigger leaf 19. In addition, spring plates 23 are fastened to lock plate 10 and press with their free ends on rear end edge 24 of trigger leaf 19, thus loading trigger 3 into an initial position.

Figure 2:
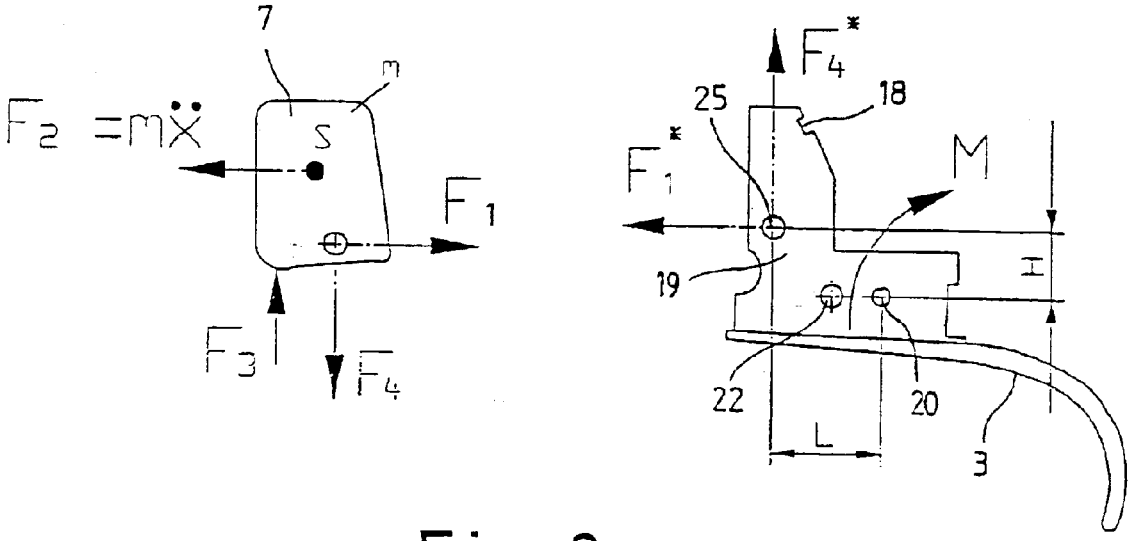
FIG. 2 shows the force conditions on a released pendulum weight and the forces exerted by the latter on the trigger upon a recoil movement of the rifle bolt in the direction of arrow x of FIG. 1.

Pendulum weight 7 separately shown in FIG. 2 is arranged on an upwardly projecting part of trigger leaf 19 in such a manner that it can pivot about pivot axis 25 parallel to trigger axis 20. Pendulum weight 7 is articulated to trigger leaf 19 in such a manner that it can pivot between a front initial position shown in FIG. 1 and a rear end position shown in FIG. 5. Pendulum weight 7 has forward projecting edge 26 on its bottom with which edge pendulum weight 7 rests in its front initial position on lock plate 10. Pendulum weight 7 also has a rear projecting edge 27 on its bottom that moves in the rear end position of pendulum weight 7 into a rest position on lock plate 10. Pivot axis 25 arranged between front edge 26 and rear and the rear edge is arranged, viewed in the direction of firing, in front of and above trigger axis 20. Pendulum weight 7 is designed in such a manner that its center of gravity s is located above pivot axis 25. Pivot axis 25 is arranged according to FIG. 2 on trigger leaf 19 with a horizontal distance L in front of trigger axis 20 and a vertical distance H above trigger axis 20. Distance L is greater in the embodiment shown than distance H. Pressure spring 28 is clamped between trigger leaf 19 and pendulum weight 7, by means of which spring the pendulum weight 7 is loaded for rotating into its front end position.

Figure 7:
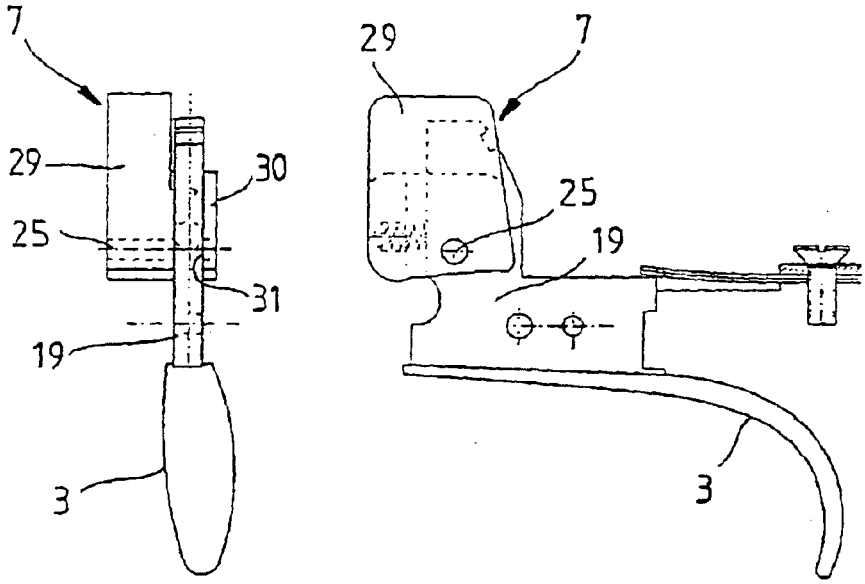
FIG. 7 shows a side view and a rear view of a rear trigger with the associated pendulum weight in the rifle bolt of FIG. 1.
Figure 8:
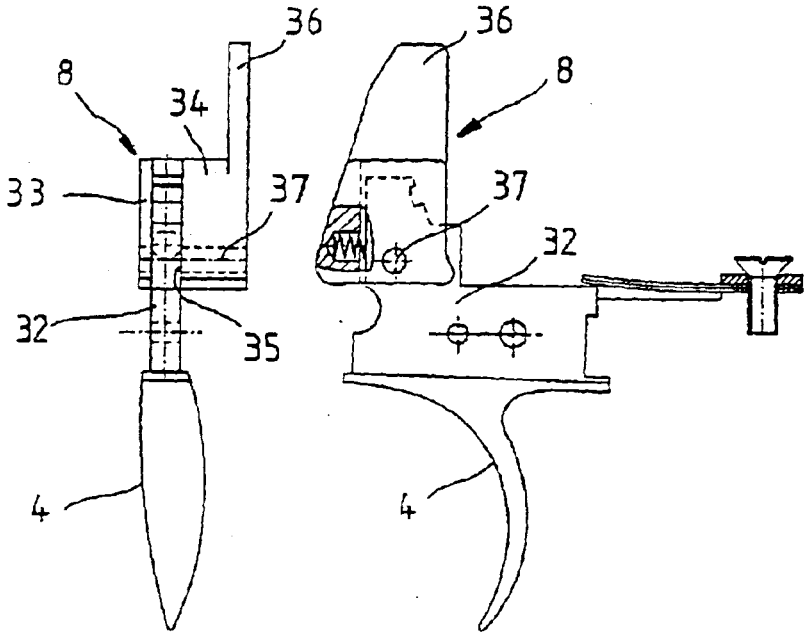
FIG. 8 shows a side view and a rear view of a front trigger with the associated pendulum weight in the rifle bolt of FIG. 1.

As is apparent from FIGS. 7 to 9, pendulum weights 7, 8 articulated to front and rear triggers 3, 4 have a different shape. Pendulum weight 7 of rear trigger 3 has a larger part 29 arranged on the outside of trigger leaf 19, a smaller part 30 arranged on the inside of the trigger leaf and a slot 31 between them for receiving trigger leaf 19. It is articulated on trigger leaf 19 of trigger 3 in such a manner that it can pivot about pivot axis 25. Pendulum weight 8 of front trigger 4 has a smaller part 33 arranged on the inside of its trigger leaf 32, a larger part 34 arranged on the outside and a slot 35 for receiving trigger leaf 32. In this pendulum weight 8 the larger part 34 has an enlarged outer web 36 extending according to FIG. 9 on the outside of firing pin piece 2. Pendulum weight 8 is articulated to trigger leaf 32 of trigger 4 in such a manner that it can pivot via pivot axis 37.

The mode of operation of the above bolt system is explained in the following using FIGS. 1 to 6.

FIG. 1 shows the initial state of the not yet released left bolt. In this state, pendulum weight 7 is loaded by the force of pressure spring 28 in such a manner that it rests with its front edge 26 on lock plate 10.

In the case of a retrograde movement of the bolt system in the direction of arrow x in FIG. 1, caused, e.g., by the recoil after the firing of a shot by the right bolt, pendulum weight 7 is pressed forward on account of its mass moment of inertia. Associated FIG. 2 shows the force conditions existing in this state on freed pendulum weight 7 with omission of the force of pressure spring 28 and shows the forces and moments acting on trigger 3 as a consequence of the acceleration of pendulum weight 7. As can be seen from FIG. 2, a moment M is produced on trigger 3 by the forces $F_1$*, $F_4$* acting on trigger 3 during the recoil movement of pendulum weight 7 which moment increases the force required to actuate the trigger, that is, the trigger resistance is increased. This moment M becomes greater the stronger the acceleration of pendulum weight 7, caused by the recoil, becomes. This means that the trigger resistance increases, the stronger the recoil is. This achieves a dynamic trigger safety. No blocking of the trigger system follows but rather only an increase of the trigger resistance proportional to the acceleration, during which the operation of the bolt system remains assured.

Figure 3:
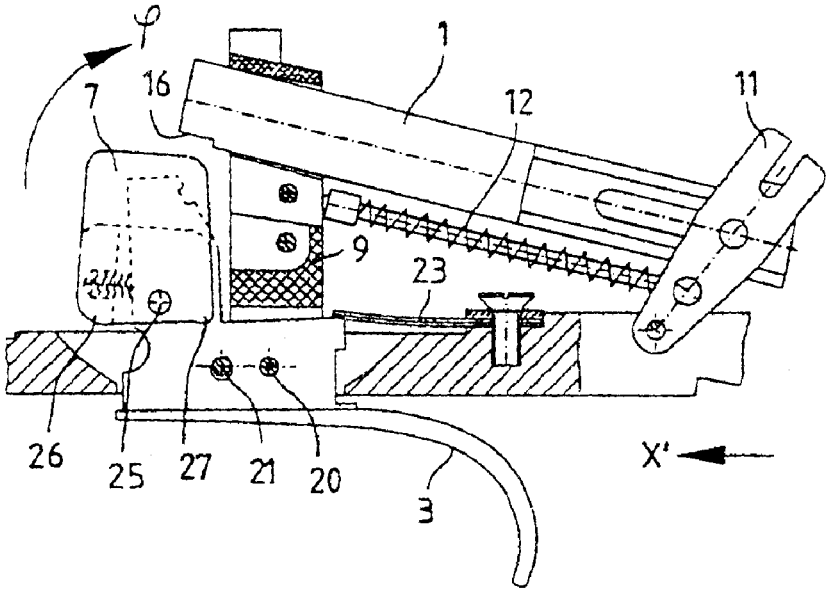
FIG. 3 shows a side view of the rifle bolt of FIG. 1 with a pendulum weight pivoted partially to the rear as a consequence of inertia upon a rebound movement of the rifle bolt in the direction of arrow x'.
Figure 4:
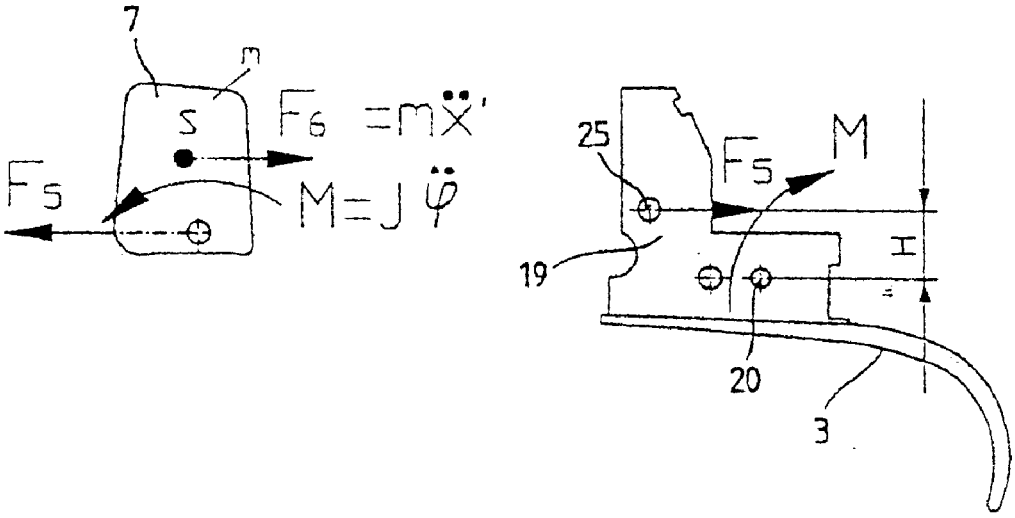
FIG. 4 shows the conditions of force and of moment on the pendulum weight and the trigger in the state of FIG. 3.

When the weapon rebounds after the recoil from the shoulder of the marksman and the bolt system moves in the opposite arrow direction x' according to FIG. 3, pendulum weight 7 is pivoted to the rear on account of its inertia through angle $\phi$. The stronger the rebound from the shoulder is, the more pendulum weight 7 is pivoted. In the case of lesser accelerations or at the start of the reversal of movement, front edge 26 of the pendulum weight lifts off from lock plate 10 according to FIG. 3 without rear edge 27 making contact with lock plate 10. Even in this phase a force $F_5$ caused by the acceleration of the pendulum mass acts according to FIG. 4 on trigger 3, which force produces a moment M on trigger 3 that increases the trigger resistance.

Figure 5:
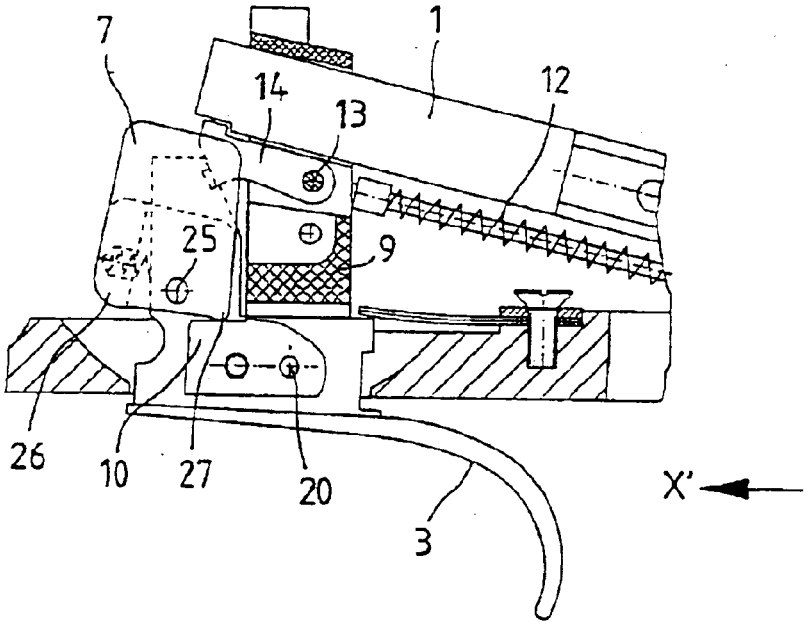
FIG. 5 shows a side view of the rifle bolt of FIG. 1 with a pendulum weight pivoted completely to the rear as a consequence of inertia upon a rebound movement of the rifle bolt in the direction of arrow x'.
Figure 6:
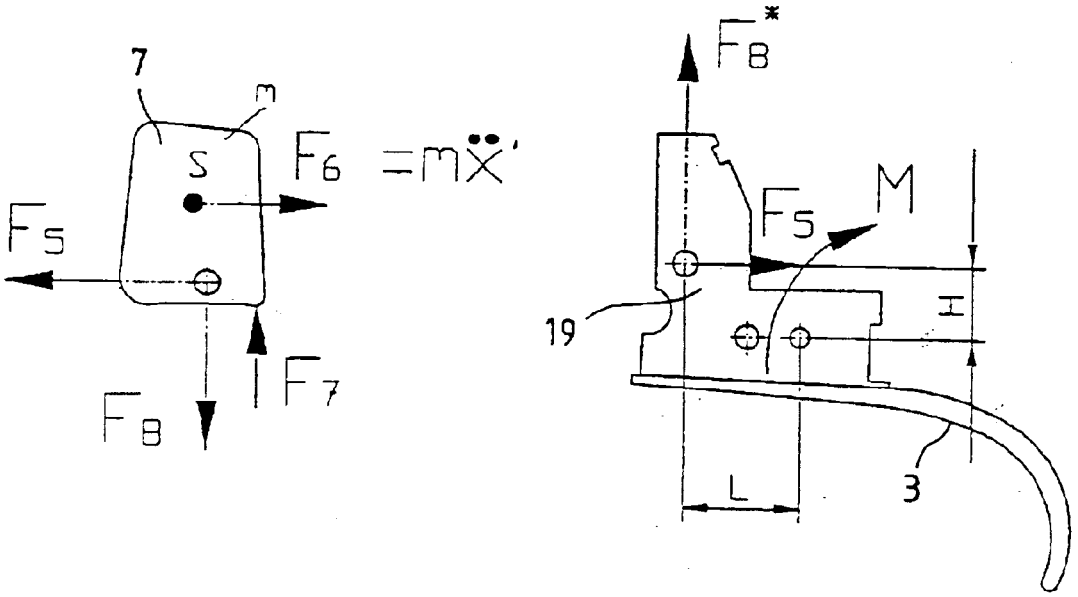
FIG. 6 shows the conditions of force and of movement on the released pendulum weight and trigger in the state of FIG. 5.

In the case of greater accelerations of the bolt system in direction x', pendulum weight 7 is pivoted so far to the rear according to FIG. 5 that its rear edge 27 comes to rest on lock plate 10. The force conditions existing in this state on freed pendulum weight 7 and the forces $F_5$ and $F^*_8$ acting as a result thereof on trigger 13 are shown in FIG. 6. Also in this phase a moment M is produced on trigger 3 by the forces $F_5$ and $F^*_8$ acting on trigger 3 as a consequence of the acceleration of the pendulum mass during the rebound, which moment increases the force required to actuate the trigger and therewith the trigger resistance.

If no acceleration forces act any longer on pendulum weight 7 after the rebound movement of the bolt system dies down, the pendulum weight is pivoted to the front under the action of spring 28 so that it comes to rest with its front edge on lock plate 10. Trigger 3 can then be actuated without an increased counter-moment until the rear edge 27 also comes to rest on lock plate 10 next to its front edge 26. Notch nose 17 of trigger lever 14 comes out of engagement thereby with recess 18 of trigger leaf 19, during which trigger lever 14 pivots downward and frees firing pin piece 1.

Although the invention has been described in terms of preferred embodiments, changes are possible as will be apparent to those of skill in the art. Such changes are deemed to fall within the invention as claimed.

What is claimed is:

1. A bolt system for multi-barrel rifles with at least two firing pin pieces, trigger levers associated with the firing pin pieces, at least one trigger rotatable about a trigger axis and at least one pivotable pendulum weight for avoiding an unintended firing of a shot, characterized in that the pendulum weight is arranged on the trigger in such a manner that it can pivot about a pivot axis, wherein the pivot axis is located, viewed in the direction of firing, in front of the trigger axis and that the center of gravity of the pendulum weight is located above the trigger axis.

2. The bolt system according to claim 1, characterized in that the pivot axis of the pendulum weight is arranged, viewed in the direction of firing, above the trigger axis and that the center of gravity of a safety part is arranged above the pivot axis.

3. The bolt system according to claim 1, characterized in that it comprises a rear trigger with a first pivotable pendulum weight and a front trigger with a second pivotable pendulum weight.

4. The bolt system according to claim 1, characterized in that the at least one pendulum weight has a front projecting edge and a rear projecting edge, wherein the front edge comes to rest on a lock plate in an initial position of the pendulum weight pivoted to the front and that the rear edge comes to rest on said lock plate in an end position of the pendulum weight pivoted to the rear.

5. The bolt system according to claim 4, characterized in that the pivot axis of the at least one pendulum weight is arranged between its front and its rear projecting edge.

6. The bolt system according to claim 1, characterized in that a pressure spring is arranged between the trigger and the pendulum weight, which spring loads the pendulum weight into an initial position pivoted to the front.

7. The bolt system according to claim 1, characterized in that the pendulum weight is articulated to a trigger leaf of the trigger.

8. The bolt system according to claim 7, characterized in that the pendulum weight comprises a larger part arranged on the outside of the trigger leaf and comprises a smaller part arranged on the inside of the trigger leaf.

9. The bolt system according to claim 7, characterized in that the pendulum weight comprises a slot for receiving the trigger leaf.

* * * * *

UNITED STATES PATENT AND TRADEMARK OFFICE

CERTIFICATE OF CORRECTION

PATENT NO. : 6,813,854 B2
DATED : November 9, 2004
INVENTOR(S) : Sergej Popikow

It is certified that error appears in the above-identified patent and that said Letters Patent is hereby corrected as shown below:

Title page,
Item [73], Assigneee, should read -- FrameMax, Inc., Riverside, California --

Signed and Sealed this

Twenty-fourth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,813,854 B2
DATED : November 9, 2004
INVENTOR(S) : Sergej Popikow

It is certified that error appears in the above-identified patent and that said Letters Patent is hereby corrected as shown below:

Title page,
Item [73], Assignee, change to -- [73] Assignee: S.A.T. Swiss Arms Technology AG, Neuhausen (CH) --

Signed and Sealed this

Nineteenth Day of July, 2005

JON W. DUDAS
*Director of the United States Patent and Trademark Office*